US010807106B2

(12) United States Patent
Bühler et al.

(10) Patent No.: US 10,807,106 B2
(45) Date of Patent: Oct. 20, 2020

(54) SWIVEL SHOWER WITH A SHUT-OFF VALVE

(71) Applicant: Hansgrohe SE, Schiltach (DE)

(72) Inventors: Jürgen Bühler, Schiltach (DE); Daniel Philipp Dieterle, Wolfach-Kirnbach (DE); Stephanie Friedrich, Schramberg (DE)

(73) Assignee: HANSGROHE SE, Schiltach (DE)

( * ) Notice: Subject to any disclaimer, the term of this patent is extended or adjusted under 35 U.S.C. 154(b) by 129 days.

(21) Appl. No.: 15/916,236

(22) Filed: Mar. 8, 2018

(65) Prior Publication Data

US 2018/0257092 A1 Sep. 13, 2018

(30) Foreign Application Priority Data

Mar. 9, 2017 (DE) ..... 10 2017 203 946

(51) Int. Cl.

| | |
|---|---|
| ***B05B 1/30*** | (2006.01) |
| ***B05B 15/74*** | (2018.01) |
| ***B05B 15/652*** | (2018.01) |
| ***B05B 1/18*** | (2006.01) |
| ***E03C 1/04*** | (2006.01) |

(52) U.S. Cl.

CPC ..... *B05B 1/3026* (2013.01); *B05B 1/18* (2013.01); *B05B 1/185* (2013.01); *B05B 1/302* (2013.01); *B05B 15/652* (2018.02); *B05B 15/74* (2018.02); *E03C 1/0408* (2013.01)

(58) Field of Classification Search

CPC ..... B05B 15/74; B05B 1/185; B05B 1/3026; E03C 1/0408

USPC ..... 239/452, 579, 587.5, 577, 538; 251/251–263, 352, 82

See application file for complete search history.

(56) References Cited

U.S. PATENT DOCUMENTS

| | | |
|---|---|---|
| 3,709,253 A | 1/1973 | Spangenberg |
| 3,718,375 A | 2/1973 | Bowler et al. |

(Continued)

FOREIGN PATENT DOCUMENTS

| | | |
|---|---|---|
| CN | 1211906 A | 3/1999 |
| DE | 10 2013 001931 A1 | 8/2014 |

(Continued)

OTHER PUBLICATIONS

European Search Report issued by the European Patent Office (Munich), dated Jul. 3, 2018, for Application No. EP18159766; 7 pages.

(Continued)

*Primary Examiner* — Jason J Boeckmann

(74) *Attorney, Agent, or Firm* — Faegre Drinker Biddle & Reath LLP

(57) ABSTRACT

Swivel shower including a shower body with a base body, a swivel body including a shower outlet and mounted for swivel movement relative to the base body between a rest position and an operating position, a shower fluid inlet and a fluid flow path from the shower fluid inlet to the shower outlet. A shut-off valve is arranged within the shower body in the fluid flow path between the shower fluid inlet and the shower outlet and blocks the fluid flow path as a function of a swivel position of the swivel body, wherein the fluid flow path is completely blocked in the rest position of the swivel body and is completely unblocked in the operating position of the swivel body.

10 Claims, 5 Drawing Sheets

(56) References Cited

U.S. PATENT DOCUMENTS

| | | | | |
|---|---|---|---|---|
| 4,147,181 | A * | 4/1979 | Hashimoto | E03C 1/0404 137/616.5 |
| 4,442,806 | A | 4/1984 | Matsuura et al. | |
| 4,995,586 | A | 2/1991 | Gensberger et al. | |
| 5,255,590 | A | 10/1993 | Klemm | |
| 6,195,814 | B1 | 3/2001 | Yoshida et al. | |
| 8,196,234 | B2 | 6/2012 | Glunk | |
| 8,632,019 | B2 * | 1/2014 | Lo | B05B 3/0409 239/222.11 |
| 2012/0286073 | A1 | 11/2012 | Zhou et al. | |
| 2014/0217202 | A1 | 8/2014 | Stein et al. | |

FOREIGN PATENT DOCUMENTS

| | | | |
|---|---|---|---|
| EP | 2 474 673 | A1 | 7/2012 |
| EP | 1 947 251 | B1 | 4/2014 |
| EP | 2 474 673 | B1 | 8/2016 |
| GB | 2 330 319 | A | 4/1999 |
| KR | 20090116868 | A | 11/2009 |
| RU | 109257 | U1 | 10/2011 |

OTHER PUBLICATIONS

Office Action dated Dec. 3, 2018 (in Russian Language) for Russian Patent Application No. 2018107969/10 (012348), with English translation of Office Action and Search Report, issued by the Federal Service for Intellectual Property, Moscow, Russian Federation.

Office Action dated Apr. 10, 2020 (in Chinese Language) for Chinese Patent Application No. 201810195152.X, with English translation of Office Action and Search Report, issued by the National Intellectual Property Administration, P.R. China.

* cited by examiner

SWIVEL SHOWER WITH A SHUT-OFF VALVE

CROSS-REFERENCE TO RELATED APPLICATION

This application claims priority to German Patent Application DE 10 2017 203 946.9, filed on Mar. 9, 2017, the disclosure of which is expressly incorporated by reference herein.

BACKGROUND AND SUMMARY OF THE DISCLOSURE

The invention relates to a swivel shower. The swivel shower has a shower body which comprises a base body, a swivel body including a shower outlet and mounted for swivel movement relative to the base body between a rest position and an operating position, a shower fluid inlet and a fluid flow path from the shower fluid inlet to the shower outlet. Rest position should be understood here as meaning a position of the swivel body in which the swivel shower is not shower-active, i.e. a shower jet does not emerge from the shower outlet. Operating position should be understood here as meaning a position of the swivel body in which the swivel shower is shower-active, i.e. the swivel shower outputs the shower fluid supplied via the shower fluid inlet at the shower outlet in the form of a shower jet.

Patent EP 1 947 251 B1 discloses a swivel shower of this type which is designed as a sanitary shower spray shower for mounting on a wall and/or the ceiling and has a shower body which comprises a base body with a flat outer surface and a swivel body arranged on the base body for swivel movement relative thereto. The swivel body is formed by a shower carrier which has one or more shower units as the shower outlet and is arranged on the base body for swivel movement relative to the base body between a shower-inactive rest position and a shower-active operating position, wherein the shower body furthermore has a shower fluid inlet and a fluid flow path from the shower fluid inlet to the shower outlet. In the case of this swivel shower, the swivel body is driven by fluid pressure. For this purpose, a swivel drive is provided which comprises a slide piston which is capable of being pressurized by a fluid pressure of the shower fluid and is pressed against the shower carrier with an end-side pressure pin at a lateral distance from the pivot axis of said shower carrier.

All kinds of swivel showers, in which a swivel body can be swivelled manually by the user into different shower positions, are customary, for example, in sanitary technology, even in embodiments with a shut-off valve which the user actuates manually via a valve operating element provided for this purpose.

A sanitary hand-held shower which is disclosed in laid-open application EP 1 759 770 A1 has a two-part shower body with two parts which are connected to each other for swivel movement, wherein a changeover valve is integrated in the one part and can be changed over by the swivelling movement of the two parts relative to each other, in order to be able to supply the supplied water to different shower outlet openings according to choice. The hand-held shower has, as customary, a connection to an associated shower hose or another corresponding water supply line.

It is an object of the invention to provide a swivel shower of the type mentioned at the outset having improved functionalities and properties in relation to the abovementioned prior art.

The invention achieves this and other objects by providing a swivel shower comprising a shower body with a base body, a swivel body including a shower outlet and mounted for swivel movement relative to the base body between a rest position and an operating position, a shower fluid inlet and a fluid flow path from the shower fluid inlet to the shower outlet, and a shut-off valve arranged within the shower body in the fluid flow path between the shower fluid inlet and the shower outlet, the shut-off valve blocking the fluid flow path as a function of a swivel position of the swivel body, wherein the fluid flow path is completely blocked in the rest position of the swivel body and is completely unblocked in the operating position of the swivel body. Advantageous, optionally realizable developments of the invention are specified in the dependent claims.

According to the invention, a shut-off valve is arranged within the shower body in the fluid flow path between the shower fluid inlet and the shower outlet, said valve being designed to block the fluid flow path as a function of a swivel position of the swivel body. In this case, it completely blocks the fluid flow path in the rest position of the swivel body and completely unblocks the same in the operating position of the swivel body. Firstly, it is thereby avoided that, in the rest position of the swivel body, in which the swivel shower is intended to be inactive, shower fluid can emerge from the shower outlet, even if shower fluid is possibly already or still present at the shower fluid inlet of the shower body or is supplied thereto. Secondly, it is ensured that, in the operating position of the swivel body, in which the swivel shower is intended to be active, shower fluid can be supplied unobstructed to the shower outlet and can emerge from the latter in the form of a desired shower jet. Therefore, in the case of the swivel shower according to the invention, the blocking of the shower fluid advantageously takes place by means of a shut-off valve which is integrated in the shower body and carries out its blocking function as a function of the swivelling of the swivel body.

In a development of the invention, the swivel shower has a swivel drive for driven swivelling of the swivel body as a function of a fluid pressure of the supplied shower fluid. As a result, by means of customary upstream regulation of the shower fluid supply to the shower body, the swivel body can be automatically swivelled between its rest position and its operating position, and, by swivelling of the swivel body, the fluid flow path in the shower body can be blocked or unblocked in the desired manner by means of the shut-off valve. No manual manipulations whatsoever on the shower body by the user are required for this purpose.

In a development of the invention, the shut-off valve has a switching hysteresis, according to which the valve starts unblocking the fluid flow path during swivelling of the swivel body from the rest position in the direction towards the operating position with a delay as compared to it completely blocking the fluid flow path during swivelling of the swivel body from the operating position in the direction towards the rest position. In other words, during swivelling of the swivel body out of the rest position, the shut-off valve blocks the shower fluid supply to the shower outlet until a predetermined unblocking swivel angle is reached, and therefore only then does shower fluid begin to emerge from the shower outlet, while, after active operation of the shower, when the swivel body is swivelled back from its operating position into its rest position, the shut-off valve completely blocks the shower fluid supply to the shower outlet only at a predetermined blocking swivel angle which lies closer to the rest position than the unblocking swivel angle. Shower fluid can therefore still emerge from the shower outlet for somewhat longer before the shut-off valve completely blocks the shower fluid supply to the shower outlet and the swivel body reaches its rest position. This may be advantageous for corresponding use situations, for example for the purpose of avoiding shower fluid which is still pressurized remaining in the shower or in the swivel body swivelled into the rest position.

In a development of the invention, the shut-off valve comprises a first valve element coupled in movement to the swivel body, and a second valve element cooperating with the first one and relative to which the first valve element is disposed to be movable. In this case, the swivelling of the swivel body causes a relative movement of the two valve elements in relation to each other, as a result of which the shut-off valve can provide the required valve functions by means of cooperation of the two valve elements.

In a refinement of the invention, the first valve element is rotatable here in relation to the second valve element and coupled for rotary movement to the swivel body. In this case, the swivelling of the swivel body causes rotation of the first valve element in relation to the second valve element, as a result of which, in turn, the required valve functions for the shut-off valve can be provided.

In a further refinement of the invention, the second valve element includes a valve closing body, while the first valve element has a valve control contour for the valve closing body, said valve control contour turning relative to the valve closing body during the swivel movement of the swivel body. As a result, the required functions of the shut-off valve are provided reliably and in a structurally advantageous manner. By rotation of the valve control contour in relation to the valve closing body, the valve closing body can cooperate with different regions of the valve control contour, and therefore said cooperation, depending on region, can bring about blocking or unblocking of the fluid flow path controlled by the shut-off valve.

In a further refinement of the invention, the first valve element includes a valve control sleeve, with the valve control contour provided on the outer circumference thereof. This constitutes a structurally and functionally advantageous realization of the first valve element which is rotatable relative to the valve closing body.

In a further refinement of the invention, the valve control contour comprises a blocking contour, with the valve closing body cooperating therewith for complete blocking of the fluid flow path, and an unblocking contour, with the valve closing body cooperating therewith for at least partial unblocking of the fluid flow path, wherein the valve closing body cooperates with the blocking contour or the unblocking contour as a function of a swivel position of the swivel body. This constitutes a structurally and functionally advantageous realization of the valve control contour of the first valve element.

In a further refinement of the invention, the blocking contour and unblocking contour, on the one hand, and the valve closing body, on the other hand, are designed or coordinated with each other in such a manner that the valve closing body during swivelling of the swivel body from the rest position to the operating position cooperates with the blocking contour until the swivel body has reached an unblocking angular position, and subsequently cooperates with the unblocking contour, and during swivelling of the swivel body from the operating position to the rest position initially cooperates with the unblocking contour until the swivel body has reached a blocking angular position, and subsequently cooperates with the blocking contour, wherein the blocking angular position is located closer to the rest position than the unblocking angular position. This constitutes a structurally advantageous possibility of realizing the abovementioned implementation of a switching hysteresis for the shut-off valve.

In a further refinement of the invention, the first valve element with its valve control contour is arranged for axial movement in relation to the valve closing body, and as a function of the swivel position and swivel direction of the swivel body assumes one of two axial positions. The blocking contour and the unblocking contour overlap here in a rotary angle overlapping region, i.e. in a corresponding overlapping region in the direction of rotation, and are adjacent in axial direction. Consequently, in this refinement, the switching over of the shut-off valve between its fully blocking position and its at least partially unblocking position can also take place by means of an axial movement of the first valve element with its valve control contour in relation to the valve closing body. This realization variant may be of advantage, for example, in conjunction with providing the switching hysteresis function mentioned.

BRIEF DESCRIPTION OF THE DRAWINGS

Advantageous embodiments of the invention are illustrated in the drawings and will be described below. In the drawings.

DETAILED DESCRIPTION OF THE DRAWINGS

Figure 1:
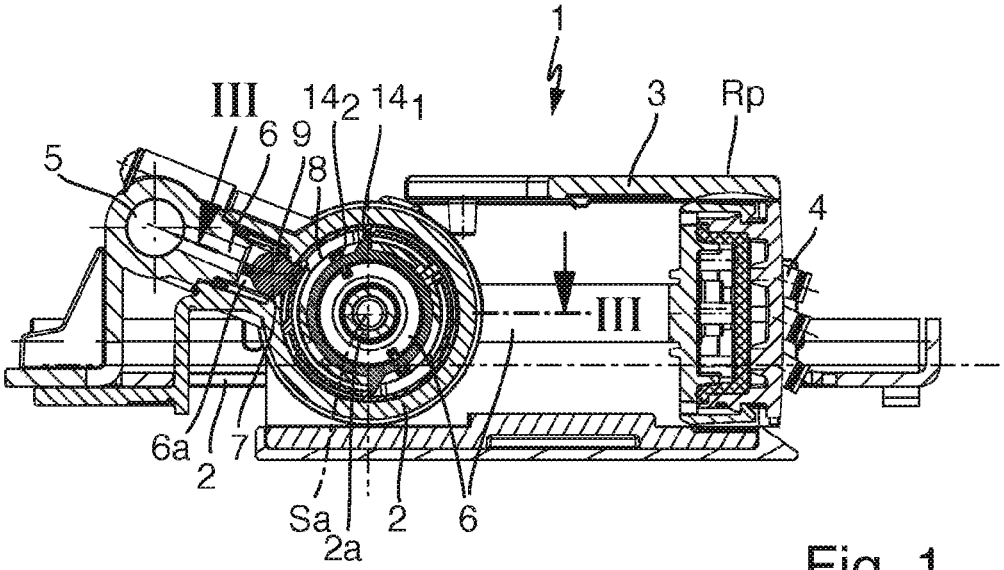
FIG. 1 shows a longitudinal sectional view of a swivel shower with a shut-off valve integrated in the shower body, in the blocking position.
Figure 2:
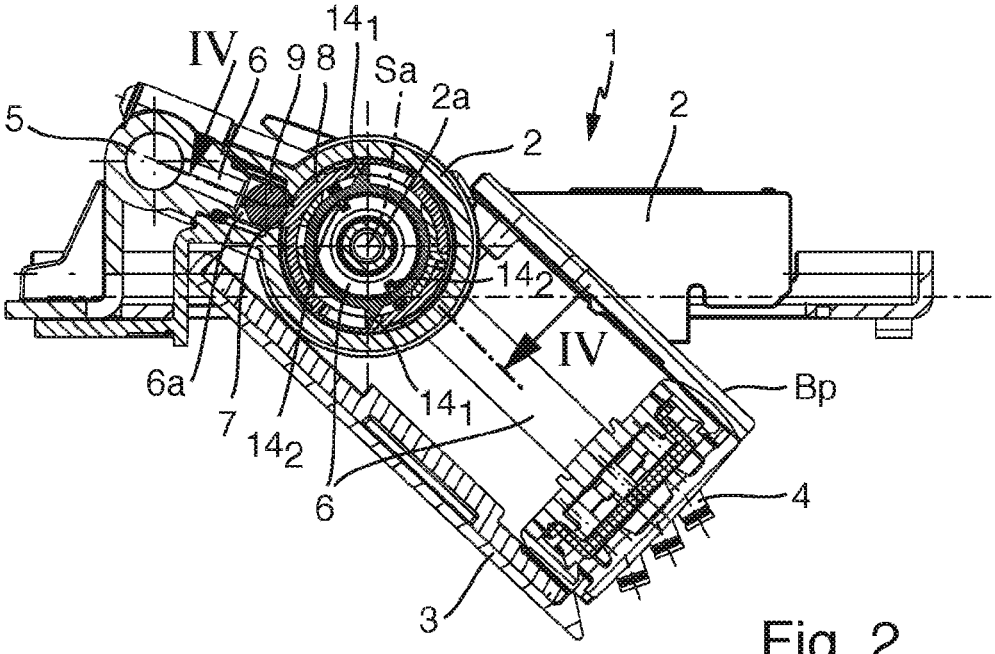
FIG. 2 shows the view of FIG. 1 with the shut-off valve in the unblocking position.

The swivel shower shown in FIGS. 1 to 7 has a shower body 1 which comprises a base body 2, a swivel body 3 with a shower outlet 4, and a shower fluid inlet 5 and a fluid flow path 6 from the shower fluid inlet 5 to the shower outlet 4. The swivel body 3 is arranged for swivel movement between a rest position Rp, which is shown in FIG. 1 and in which the swivel shower is not in the active shower mode, and an operating position Bp which is shown in FIG. 2, wherein the operating position Bp of the swivel body 3 forms a position for an active shower mode, in which shower fluid, such as water, which is supplied to the shower fluid inlet 5 can pass via the fluid flow path 6 to the shower outlet 4 and can be output there from the swivel shower in the form of a desired shower jet. Unless shown and described specifically here, the swivel shower can furthermore be of any desired conventional valve constructions with which a person skilled in the art is familiar. The swivel shower can be designed in particular as a sanitary swivel shower, for example as a ceiling- or wall-mounted over-head shower or side shower which can be swivelled, for shower rooms.

A shut-off valve 7 is arranged within the shower body 1 in the fluid flow path 6 between the shower fluid inlet 5 and the shower outlet 4, said shut-off valve blocking the fluid flow path 6 as a function of a swivel position of the swivel body 3, wherein it completely blocks the fluid flow path 6 in the rest position Rp of the swivel body 3 and completely unblocks same in the operating position Bp of the swivel body 3.

In the exemplary embodiment shown, the shut-off valve 7 comprises a first valve element 8 coupled in movement to the swivel body 3, and a second valve element 9 cooperating with the first one, wherein the first valve element 8 is disposed to be movable relative to the second valve element 9.

In the exemplary embodiment shown, the first valve element 8 is rotatable in relation to the second valve element 9 and coupled for rotary movement to the swivel body 3. Alternatively, another conventional type of movement coupling of the first valve element 8 to the swivel body 3 can be provided, for example using a gearing which converts the swivel movement of the swivel body 3, for example, into a linear movement of the first valve element 8. In the example shown, the first valve element 8 is coupled to the swivel body 3 for rotation therewith via a connection stub 3*a* of the swivel body 3, wherein the connection stub 3*a* is mounted by a sleeve-shaped portion 3*b* on a bearing sleeve 2*b* of the base body 2 so as to be rotatable about a swivel axis Sa of the swivel body 3. The bearing sleeve 2*b* sits on an annular stub 2*a* of the base body 2 for rotation therewith. The first valve element 8, for example in the form of a valve control sleeve 8*a*, sits on the sleeve-shaped portion 3*b* for rotation therewith and in an axially movable manner. In alternative embodiments, the first valve element 8 can be coupled for rotary movement to the swivel body 3 via a gearing, if required with a predeterminable step-up or step-down.

In the exemplary embodiment shown, the second valve element 9 includes a valve closing body 9*a*, which can be, for example, a conventional valve ball or another conventional valve closing body, such as a valve disc or a valve cone. The first valve element 8 or the valve control sleeve 8*a* has a valve control contour 10 for the valve closing body 9*a*, said valve control contour turning relative to the valve closing body 9*a* during the swivel movement of the swivel body 3. In the example shown, the valve control contour 10 is formed on the outer circumference of the valve control sleeve 8*a*. In alternative embodiments, the first valve element 8 is not designed as a sleeve, but rather has a different form, for example as a valve control cylinder or valve control ball, on the surface of which the valve control contour 10 is formed.

In the realization as is apparent from FIGS. 1 to 6, the, for example, spherical valve closing body 9*a* is arranged movably in a channel portion 6*a*, which is formed in the base body 2, of the fluid flow path 6, for example is movable parallel to a longitudinal axis K of the channel portion 6*a*. In a blocking position shown in FIG. 3, the valve closing body 9*a* sits in a sealing manner against a valve seat 11 which is shaped in a corresponding manner, for example in the form of a section of a spherical shell and which is formed on the base body 2 and thereby completely blocks the fluid flow path 6. In an unblocking position shown in FIG. 4, the valve closing body 9*a* is in a position raised from the valve seat 11, wherein the valve control contour 10, by rotation of the first valve element 8 or of the valve control sleeve 8*a*, pushes the valve closing body 9*a* out of its blocking position of FIG. 3 and keeps same in the raised unblocking position of FIG. 4.

Figure 3:
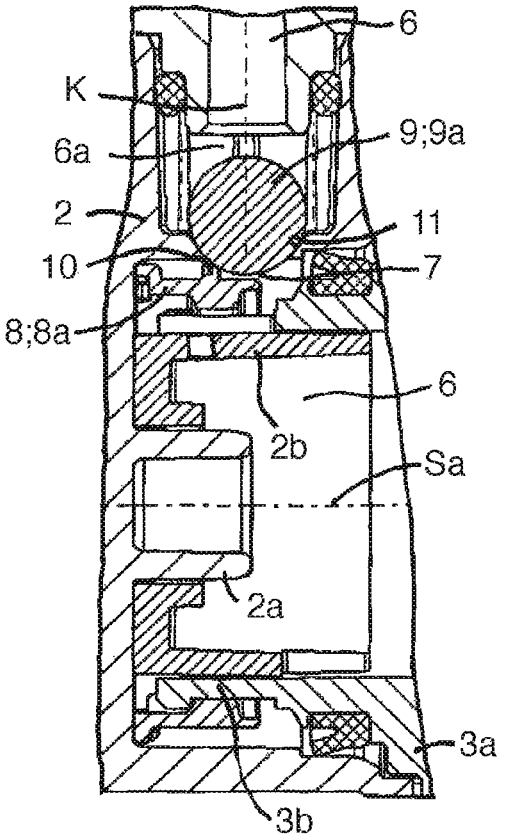
FIG. 3 shows a sectional view along a line III-III from FIG. 1.

The valve position of FIG. 3 therefore constitutes a blocking position of the shut-off valve 7, in which the latter is located at least if the swivel body 3 assumes its rest position Rp according to FIG. 1. As a result, the shut-off valve 7 ensures that, in the rest position Rp of the swivel body 3, no shower fluid can emerge from the shower outlet 4, and therefore the shower is in the shower-inactive state, as desired.

Figure 4:
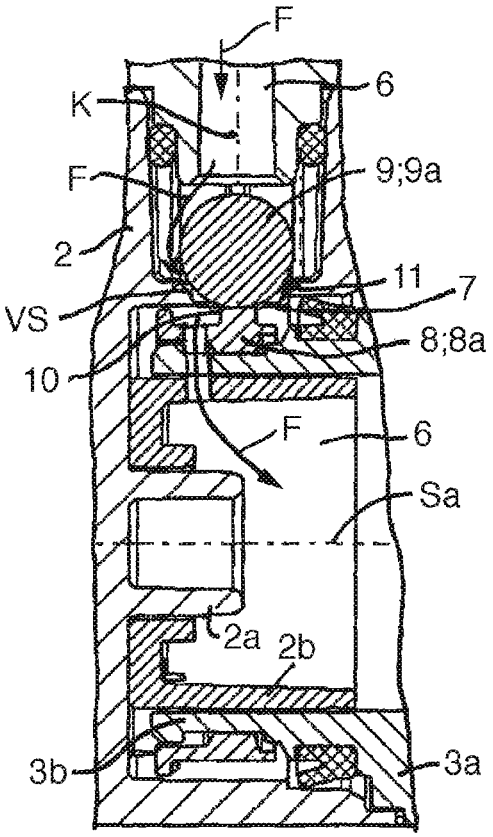
FIG. 4 shows a sectional view along a line IV-IV from FIG. 2.

By contrast, in the valve position of FIG. 4, the shut-off valve 7 is in its unblocking position, in which it at least partially unblocks the fluid flow path 6. This is realized in the example shown by the fact that, by raising the valve closing body 9*a* from the valve seat 11, a through gap VS exists between the valve closing body 9*a* and the valve seat 11. With the through gap VS, the shut-off valve 7 keeps the fluid flow path 6 passable, i.e. open, and therefore shower fluid which is supplied and passes into the channel portion 6*a* can flow past the valve closing body 9*a* through the valve-side through gap VS in the direction of the shower outlet 4, as illustrated with flow arrows F. The shut-off valve 7 assumes said unblocking position in particular whenever the swivel body 3 is in its shower-active operating position Bp according to FIG. 2.

In an advantageous realization, the shut-off valve 7 has a switching hysteresis, according to which the valve starts unblocking the fluid flow path 6 during swivelling of the swivel body 3 from the rest position Rp in the direction towards the operating position Bp with a delay as compared to it completely blocking the fluid flow path during swivelling of the swivel body 3 from the operating position Bp in the direction towards the rest position Rp. In other words, when the swivel body 3 is swivelled out of its rest position Rp, the shut-off valve 7 remains in its blocking position according to FIGS. 1 and 4 until the swivel body 3 reaches an unblocking angular position which is defined by a predeterminable unblocking angle. Further swivelling of the swivel body 3 in the direction of the operating position Bp has the result that the shut-off valve 7 is actuated and thereby unblocks, i.e. opens, the fluid flow path 6. This can take place abruptly or continuously, depending on requirements and corresponding design of the system, wherein, in each case, the shut-off valve 7 has reached its position completely opening or unblocking the fluid flow path 6 according to FIGS. 2 and 4 when the swivel body 3 has reached its operating position Bp.

When the swivel body 3 is swivelled back from its operating position Bp into its rest position Rp, the shut-off valve 7 initially remains in a position at least partially unblocking the fluid flow path 6 until the swivel body 3 has reached a blocking angular position which is defined by a correspondingly predetermined blocking angle of the swivel body 3. According to the implemented switching hysteresis, said blocking angular position of the swivel body 3 is located closer to the rest position Rp than the unblocking angular position, i.e. the angle between the rest position angular position and the blocking angular position of the swivel body 3 is smaller than the angle between the rest position angular position and the unblocking angular position. Only when the swivel body 3 has reached or exceeded its blocking angular position does the shut-off valve 7 assume its blocking position, in which it completely blocks the fluid flow path 6, wherein it maintains said blocking position during the possibly remaining swivelling of the swivel body 3 back into its rest position Rp. In a corresponding realization, the blocking angular position of the swivel body 3 may also coincide with its rest position Rp, i.e. in this case, the shut-off valve 7 completely blocks the fluid flow path 6 only when the swivel body 3 has reached its rest position Rp when swivelling back.

This switching hysteresis of the shut-off valve 7 may be of advantage for corresponding use situations, since it makes it possible that, when swivelling the swivel body 3 back out of its operating position Bp into its rest position Rp, shower fluid can still emerge from the shower outlet 4 for a relatively long time while, on the other hand, when the swivel body 3 is swivelled out of its rest position Rp in the direction of the operating position Bp, the emergence of shower fluid from the shower outlet 4 remains suppressed until the swivel body 3 has reached its unblocking angular position.

Figure 5:
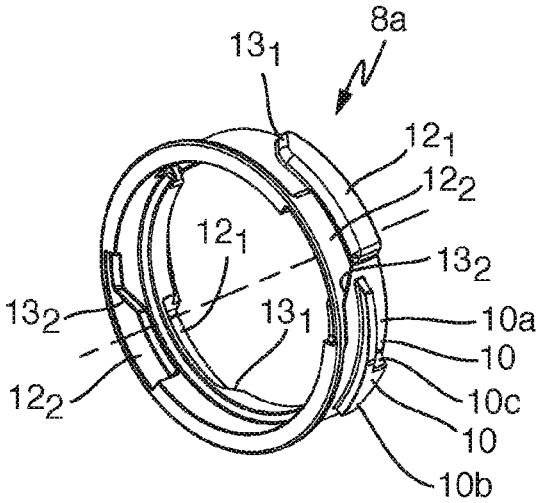
FIG. 5 shows a perspective view of a valve seat sleeve of the shut-off valve.
Figure 6:
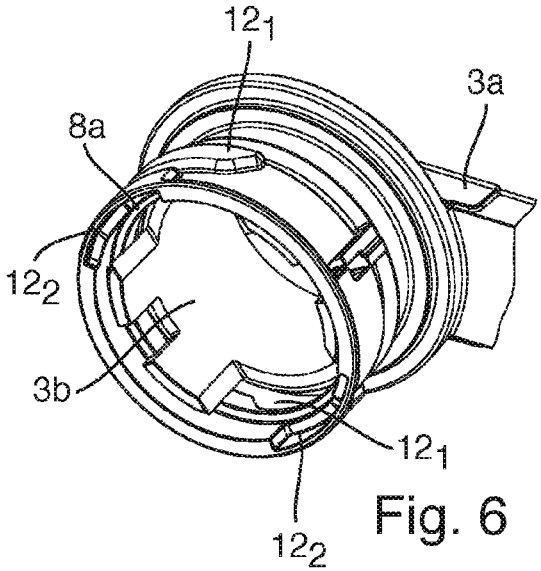
FIG. 6 shows a perspective view of a rotatable valve element of the shut-off valve with the valve seat sleeve.
Figure 7:
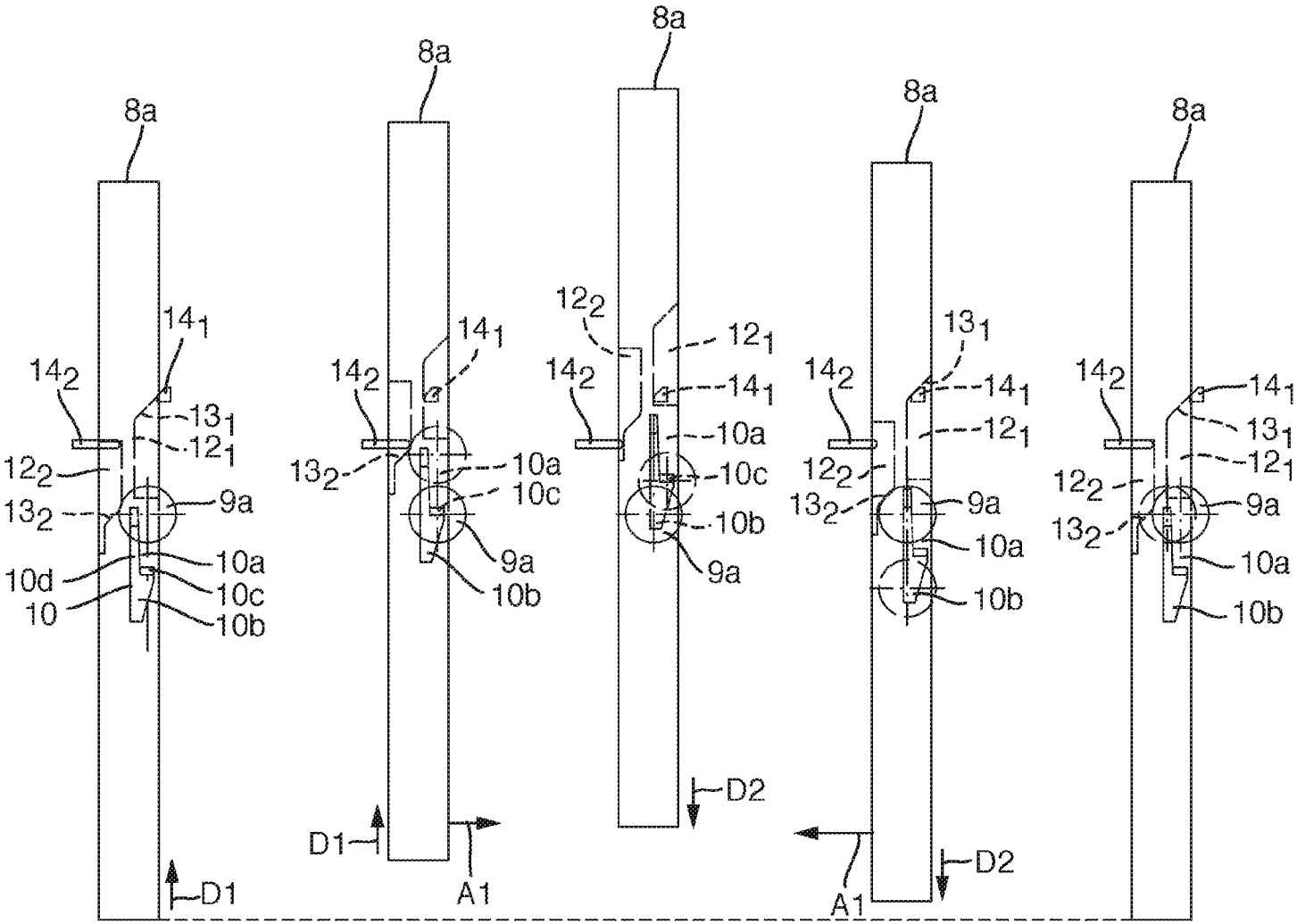
FIG. 7 shows an illustration of a development of a valve seat sleeve according to FIG. 5 or 6 in various valve positions.

An advantageous possibility of realizing said switching hysteresis can be seen in the exemplary embodiment shown, in particular with reference to FIGS. 5 to 7. FIG. 6 here shows a realization of the valve control sleeve 8*a* which is laterally reversed with respect to that of FIG. 5. FIG. 7 illustrates the valve control sleeve 8*a* of FIG. 5 in an illustration of the development in five different successive positions A to E over the course of a swivelling movement operation of the swivel body 3. As is apparent therefrom, the valve control sleeve 8*a* comprises, on its outer lateral surface, the valve control contour 10 in the form of a radially inner blocking contour 10*a* and an unblocking contour 10*b* protruding radially outwards in relation thereto. In addition, the valve control sleeve 8*a* has at least one first axial guiding contour $\mathbf{12}_1$ and at least one second axial guiding contour $\mathbf{12}_2$, which axial guiding contours are each formed by regions of the sleeve lateral surface that bulge radially outwards and each comprise an associated first or second oblique surface $\mathbf{13}_1$, $\mathbf{13}_2$ at opposite ends in the direction of rotation. In the example shown, two diametrically opposite first and second axial guiding contours are provided in each case. A respective first axial guiding cam $\mathbf{14}_1$ formed on the base body 2 cooperates with each first axial guiding contour $\mathbf{12}_1$, and a respective second axial guiding cam $\mathbf{14}_2$ formed on the base body 2 cooperates with the second axial guiding contour $\mathbf{12}_2$.

Position A, on the left in FIG. 7, of the valve seat sleeve 8*a* corresponds to the blocking position of the shut-off valve 7 according to FIGS. 1 and 3 in the rest position Rp of the swivel body 3. The valve closing body 9*a*, which is indicated in FIG. 7 in its relative position with respect to the valve seat sleeve 8*a* and by dashed lines in its respectively previous position for better understanding, cooperates in this position with the blocking contour 10*a* of the valve control contour 10. Since the blocking contour 10*a* is located lower than the unblocking contour 10*b*, i.e. further radially inward on the valve control sleeve 8*a*, the blocking contour 10*a* allows the valve closing body 9*a* to assume its blocking position bearing fluid-tightly against the valve seat contour 11.

If the swivel body 3 is swivelled out of its rest position Rp, the valve control sleeve 8*a* correspondingly rotates in relation to the valve closing body 9*a*, symbolized by an arrow D1, wherein the valve closing body 9*a* first of all continues to cooperate with the blocking contour 10*a* extending over a corresponding angle of rotation length or circumferential length until the swivel body 3 has reached its unblocking angular position, in which the valve control sleeve 8*a* is then in position B of FIG. 7. In said position B of the valve control sleeve 8*a*, the unblocking contour 10*b* begins to cooperate with the valve closing body 9*a*. For this purpose, the unblocking contour 10*b* optionally has an oblique run-on surface 10*c* which can make it easier for the valve closing body 9*a* to pass from the lower region of the blocking contour 10*a* onto the higher region of the unblocking contour 10*b*. In addition, the oblique run-on surface 10*c* stabilizes the opening of the shut-off valve 7 by means of the correspondingly continuous raising of the valve closing body 9*a* from the valve seat contour 11 in order to form the full through gap VS. During further swivelling of the swivel body 3 in the direction of the operating position Bp, the valve closing body 9*a* cooperates with the unblocking contour 10*b*, wherein, in the example shown, the unblocking contour 10*b* raises the valve closing body 9*a* from the valve seat contour 11, and therefore the shut-off valve 7 opens the fluid flow path 6.

In addition, during further swivelling of the swivel body 3 in the direction of its operating position Bp, the cooperation of the second axial guiding contour $\mathbf{12}_2$ with the second axial guiding cam $\mathbf{14}_2$ brings about an axial displacement of the valve control sleeve 8*a* in relation to the valve closing body 9*a*, symbolized by an arrow A1, by the second axial guiding contour $\mathbf{12}_2$ running up with its oblique surface $\mathbf{13}_2$ against the second axial guiding cam $\mathbf{14}_2$ which is stationary on the base body 2. By means of said axial displacement of the valve control sleeve 8*a* relative to the valve closing body 9*a* to the right in FIG. 7, nothing changes with regard to the cooperation of the valve closing body 9*a* with the unblocking contour 10*b*, for which purpose the latter has a sufficient axial width. The central partial image in FIG. 7 then shows the position C of the valve control sleeve 8*a* when the swivel body 3 has reached its operating position Bp.

When the swivel body 3 is swivelled back out of its operating position Bp in the direction of the rest position Rp and, as a result, the valve control sleeve 8*a* is rotated back, see arrow D2, the shut-off valve 7 initially remains in its unblocking position by the valve closing body 9*a* continuing to cooperate with the unblocking contour 10*b*, specifically until the swivel body 3 reaches its blocking angular position. This then corresponds to the position D of the valve control sleeve 8*a* in FIG. 7. In the axial position, in which the valve control sleeve 8*a* is located during this portion of the return swivel movement of the swivel body 3, the unblocking contour 10*b* extends with a narrow web region 10*d* beyond the oblique run-on surface 10*c* in the direction of the angle of rotation. As a result, when the swivel body 3 is swivelled back, the valve closing body 9*a* remains for correspondingly longer in its position raised from the valve seat contour 11, and the shut-off valve 7 remains for correspondingly longer in its unblocking position, and this provides the switching hysteresis mentioned. In FIG. 7, the switching hysteresis can be seen by the fact that the valve control sleeve 8*a*, with its rotational position in the position D, is located closer to the position A than in the position B, wherein, as stated, the position A corresponds to the rest position Rp of the swivel body 3 and the position B corresponds to the unblocking angular position of the swivel body 3. In alternative embodiments without switching hysteresis, the narrow web region 10*d* of the unblocking contour 10*b* can be omitted.

During further swivelling of the swivel body 3 back in the direction of the rest position Rp, the cooperation of the first axial guiding contour $\mathbf{12}_1$ with the first axial guiding cam $\mathbf{14}_1$ becomes active by the associated first oblique surface $\mathbf{13}_1$ running up against the first axial guiding cam $\mathbf{14}_1$. This leads to an axial displacement of the valve control sleeve 8*a* backwards, see arrow A2, as a result of which the valve closing body 9*a* passes axially out of the narrow web region 10*d* of the unblocking contour 10*b* and changes into the lower region of the axially adjacent blocking contour 10*a*. By means of this renewed cooperation of the valve closing body 9*a* with the blocking contour 10*a*, the valve closing body 9*a* can resume its position which completely blocks the fluid flow path 6 and in which it bears fluid-tightly against the valve seat contour 11. When the swivel body 3 has reached its rest position Rp, the valve control sleeve 8*a* has also reached its corresponding starting position corresponding to the position A in FIG. 7 again.

Therefore, in this realization, the first valve element 8 with its valve control contour 10 is arranged for axial movement in relation to the valve closing body 9*a*, and as a function of the swivel position and swivel direction of the swivel body assumes one of two axial positions, wherein the blocking contour 10*a* and the unblocking contour 10*b* overlap, here with the web region 10*d*, in a rotary angle overlapping region and are adjacent in axial direction.

As mentioned above, the shut-off valve 7 illustrated in FIGS. 1 to 7 can be used for any type of swivel shower having a swivel body which can be swivelled in relation to a base body. Depending on use, the swivel body 3 can be swivelled manually by the user or automatically by means of a drive.

Figure 8:
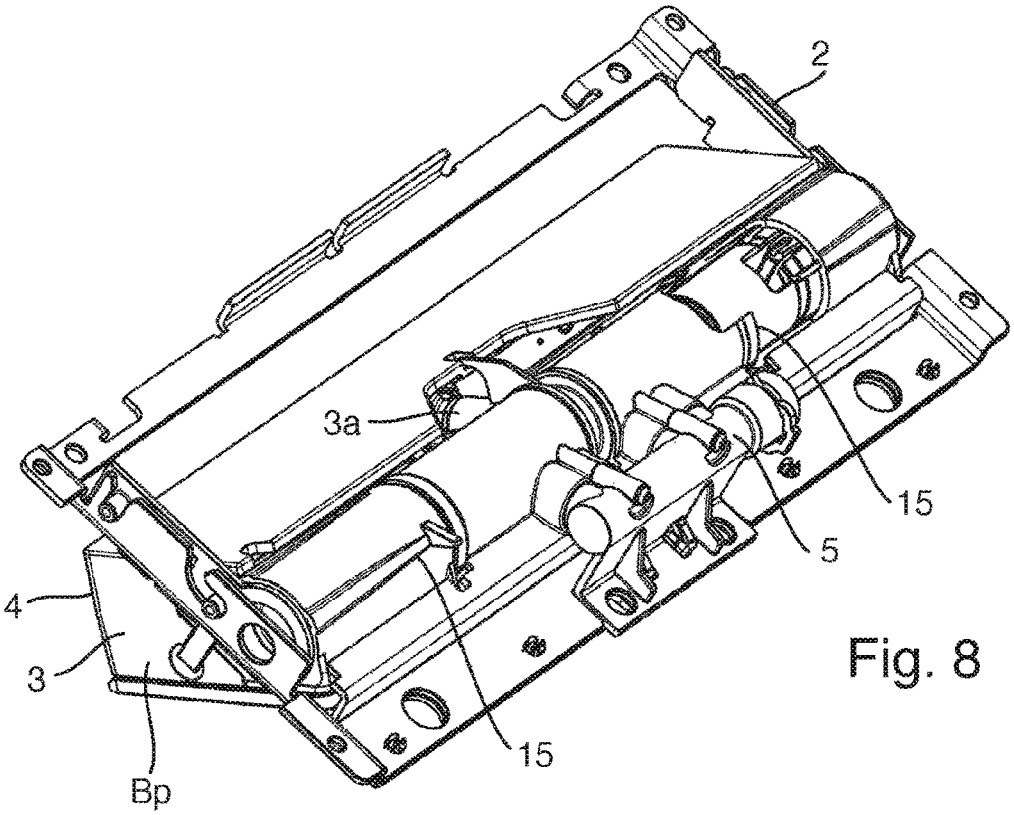
FIG. 8 shows a perspective view of a swivel shower with a swivel body driven by fluid pressure and two shut-off valves of the type shown in FIGS. 1 to 7 in a shower-active swivel position.
Figure 9:
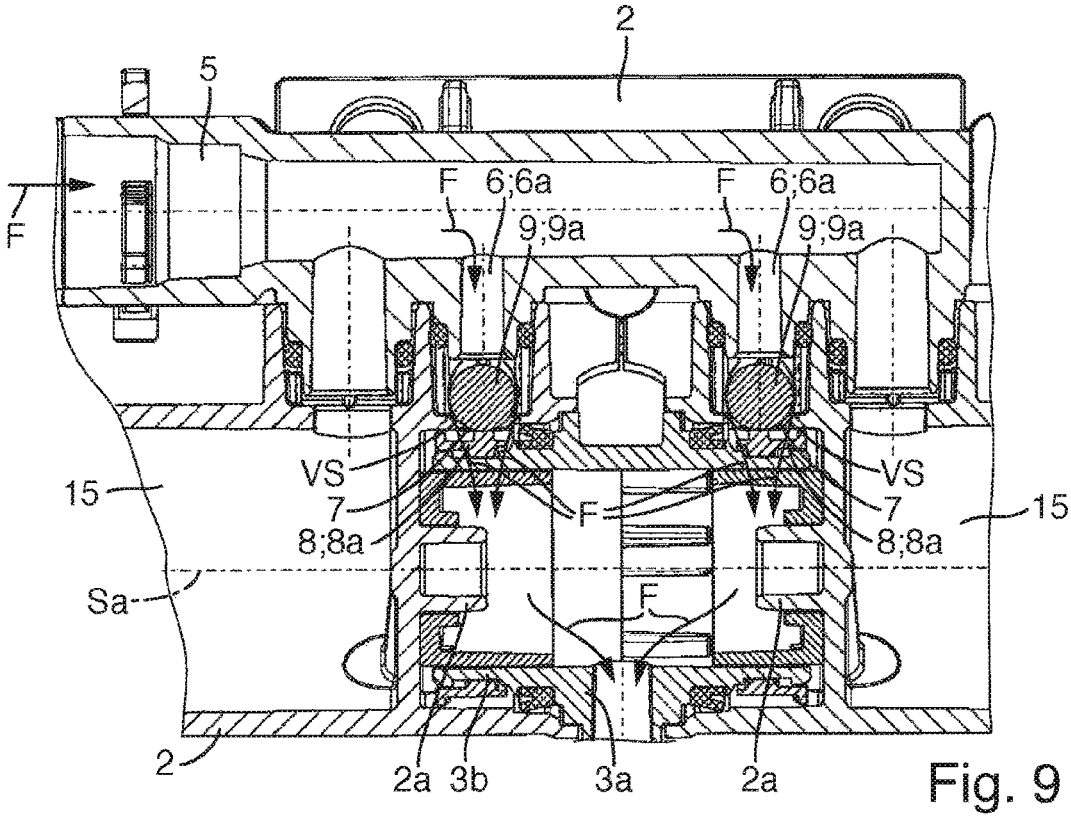
FIG. 9 shows a detailed sectional view of the swivel shower of FIG. 8 in a shut-off valve region.
Figure 10:
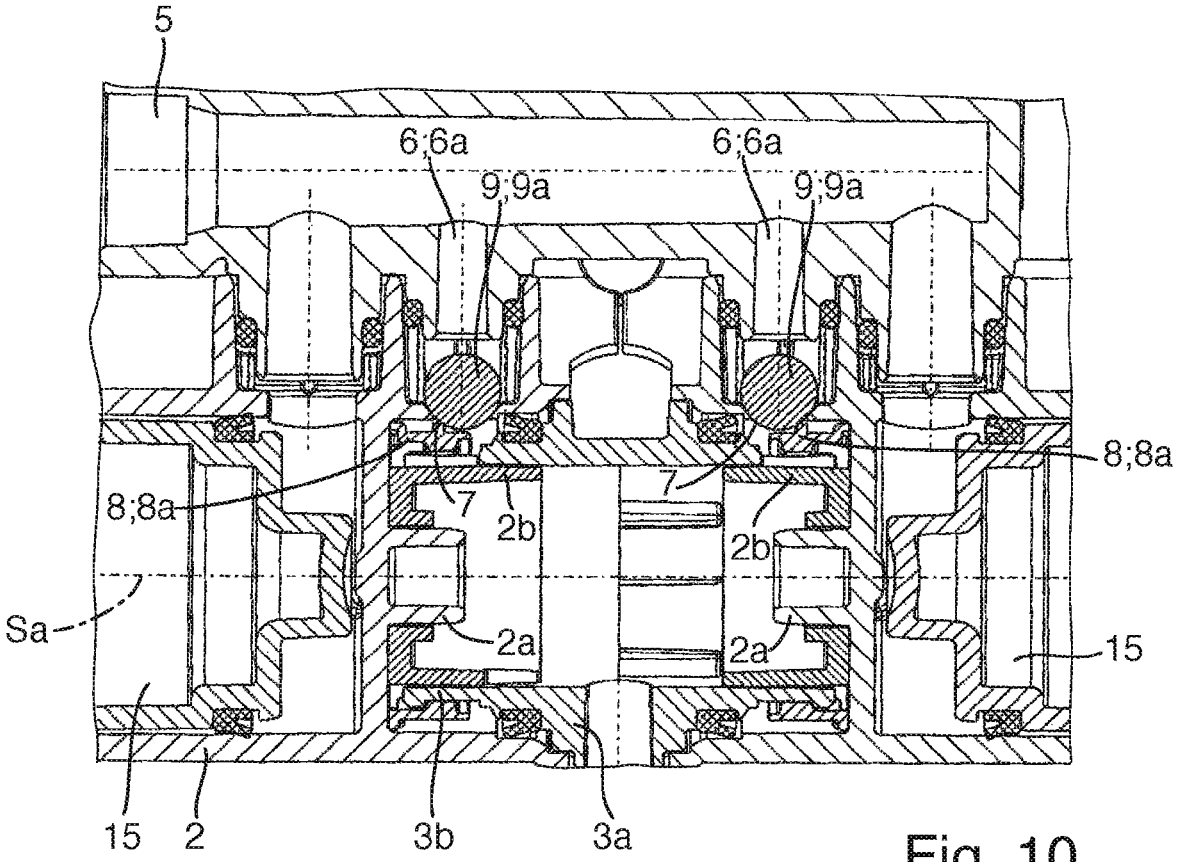
FIG. 10 shows the sectional view of FIG. 9 in a shower-inactive position of the swivel shower.

FIGS. 8 to 10 illustrate the use of the shut-off valve 7 in a swivel shower, as can be used in particular as a ceiling-mounted over-head shower or wall-mounted side shower in shower installations. This example of realizing a swivel shower according to the invention comprises a swivel drive 15 for the driven swivelling of the swivel body 3 as a function of a fluid pressure of the supplied shower fluid. Details of said swivel drive are indicated in a German Patent Application (our reference: P56337 DE) which has been filed at the same time and the contents of which are hereby fully incorporated in the present application by reference, and do not need any further explanation here. Alternatively, the swivel shower illustrated in FIGS. 8 to 10 with a frame-shaped base body 1 and cassette-shaped swivel body 2 can also be swivelled manually by the user, or by another conventional swivel drive. As is apparent in particular from FIG. 8, this swivel shower with the exception of a fluid inlet pipe defining the shower fluid inlet 5 has a construction which is substantially symmetrical with respect to a centre plane and correspondingly two shut-off valves 7 of the type explained with respect to FIGS. 1 to 7 are installed in said swivel shower, in an arrangement symmetrical with respect to said centre plane, and operate synchronously.

FIGS. 8 and 9 show the swivel shower with the swivel body 3 in its operating position Bp. Accordingly, the two shut-off valves 7 are in their unblocking position in which they completely unblock the fluid flow path 6, which is divided here into two parallel branches, by means of the respective through gap VS. As a result, shower fluid F supplied via the shower fluid inlet 5 can flow into the two parallel channel portions 6*a* and through the valve through gaps VS into the connection stub 3*a* of the swivel body 3 and from there on to the shower outlet 4 thereof. In this respect, this position of the swivel body 3 and of the shut-off valves 7 corresponds to that of FIGS. 1 and 3.

FIG. 10 shows the swivel shower in the shut-off valve region analogously to FIG. 9 when the swivel shower is in its inactive state, i.e. when the swivel body 3 is in its rest position Rp. In this case, the shut-off valves 7 completely block the fluid flow path. In this respect, this position corresponds to that of FIGS. 2 and 4. With regard to further details in respect of the function of the shut-off valves 7, reference can be made to the above statements as regards FIGS. 1 to 7.

As the exemplary embodiments shown and explained above make clear, the invention provides a swivel shower having highly advantageous properties and a relatively simple construction, wherein a shut-off valve is integrated in the shower body, said shut-off valve operating in reaction to swivelling of a swivel body of the shower which is movable with a swivel movement in relation to a base body. The swivel shower is usable in particular in the sanitary region and here especially as a wall- or ceiling-mounted side shower or over-head shower. However, it goes without saying that the swivel shower is usable beneficially in the same manner for non-sanitary uses wherever there is a need for a shower with a shower outlet which can be swivelled.

The invention claimed is:

1. A swivel shower, comprising:

a shower body with a base body, a swivel body including a shower outlet and mounted for swivel movement relative to the base body between a rest position and an operating position, a shower fluid inlet and a fluid flow path from the shower fluid inlet to the shower outlet;

a shut-off valve arranged within the shower body in the fluid flow path between the shower fluid inlet and the shower outlet, the shut-off valve blocking the fluid flow path as a function of a swivel position of the swivel body, wherein the fluid flow path is completely blocked in the rest position of the swivel body and is completely unblocked in the operating position of the swivel body; and wherein the shut-off valve has a switching hysteresis, the switching hysteresis providing at least one position of the swivel body providing a first valve position and a second valve position depending on whether the swivel body is swiveled in a first direction or a second, opposite direction, wherein the shut-off valve according to the switching hysteresis starts unblocking the fluid flow path during swiveling of the swivel body from the rest position in the first direction towards the operating position with a delay as compared to the shut-off valve completely blocking the fluid flow path during swiveling of the swivel body from the operating position in the second direction towards the rest position.

2. The swivel shower according to claim 1, further comprising a swivel drive for driven swiveling of the swivel body as a function of a fluid pressure of the supplied shower fluid.

3. The swivel shower according to claim 1, wherein the shut-off valve has a first valve element coupled in movement to the swivel body, and a second valve element cooperating with the first one, wherein the first valve element is disposed to be movable relative to the second valve element.

4. The swivel shower according to claim 3, wherein the first valve element is rotatable in relation to the second valve element and coupled for rotary movement to the swivel body.

5. The swivel shower according to claim 4, wherein the second valve element includes a valve closing body, and the first valve element has a valve control contour for the valve closing body, wherein the valve control contour turns relative to the valve closing body during the swivel movement of the swivel body.

6. The swivel shower according to claim 5, wherein the first valve element includes a valve control sleeve with the valve control contour provided on the outer circumference thereof.

7. The swivel shower according to claim 5, wherein the valve control contour comprises a blocking contour, with the valve closing body cooperating therewith for complete blocking of the fluid flow path, and an unblocking contour, with the valve closing body cooperating therewith for at least partial unblocking, wherein the valve closing body cooperates with the blocking contour or the unblocking contour as a function of a swivel position of the swivel body.

8. The swivel shower according to claim 7, wherein the valve closing body during swiveling of the swivel body from the rest position to the operating position cooperates with the blocking contour until the swivel body has reached an unblocking angular position, and subsequently cooperates with the unblocking contour, and during swiveling of the swivel body from the operating position to the rest position initially cooperates with the unblocking contour until the swivel body has reached a blocking angular position, and subsequently cooperates with the blocking contour, wherein the blocking angular position is located closer to the rest position than the unblocking angular position.

9. The swivel shower according to claim 7, wherein the first valve element with its valve control contour is arranged for axial movement in relation to the valve closing body, and as a function of the swivel position and swivel direction of the swivel body assumes one of two axial positions, and the blocking contour and the unblocking contour overlap in a rotary angle overlapping region and are adjacent in axial direction.

10. The swivel shower according to claim 1, wherein the swivel shower is a sanitary swivel shower.

* * * * *